United States Patent [19]

Altnau, Sr.

[11] Patent Number: 5,044,178

[45] Date of Patent: Sep. 3, 1991

[54] RINSE AID DISPENSER

[75] Inventor: Ronald L. Altnau, Sr., Ripon, Wis.

[73] Assignee: Speed Queen Company, Ripon, Wis.

[21] Appl. No.: 647,335

[22] Filed: Jan. 28, 1991

[51] Int. Cl.[5] ..... D06F 39/02

[52] U.S. Cl. ..... 68/17 A

[58] Field of Search ..... 68/17 A

[56] References Cited

U.S. PATENT DOCUMENTS

| | | | |
|---|---|---|---|
| 2,982,120 | 5/1961 | Pelensky | 68/17 A X |
| 3,290,908 | 12/1966 | McAllister et al. | 68/17 A |
| 3,370,444 | 2/1968 | Wolters | 68/17 A X |
| 4,118,957 | 10/1978 | Marcussen | 68/17 A |
| 4,656,844 | 4/1987 | Mulder et al. | 68/17 A |

*Primary Examiner*—Philip R. Coe

*Attorney, Agent, or Firm*—William R. Clark; Richard M. Sharkansky

[57] ABSTRACT

A compact rinse aid dispenser that mounts on top of the agitator post and dispenses a rinse aid during the rinse cycle. The rinse aid is held in a conical-shaped cup during the wash/agitate cycle, and then is sprayed out and retained against the inner wall of the housing by centrifugal force during the spin cycle. The rinse aid then drains down through a funnel into the agitator post and out a slot therein when the spinning stops. The dispenser has a lid with a horizontal wall and a cylindrical downwardly extending barrier around the fill hole to prevent rinse aid from being sprayed back out the fill hole as a result of an out-of-balance load that causes the agitator post and dispenser to orbit about the vertical axis. Further, a labyrinth is provided around the drain hole in the funnel to prevent premature draining of rinse aid into the agitator post.

17 Claims, 3 Drawing Sheets

RINSE AID DISPENSER

BACKGROUND OF THE INVENTION

The field of the invention generally relates to automatic washing machines, and more particularly relates to rinse aid dispensers for such automatic washing machines.

As is well known, it may be desirable to add a liquid rinse aid such as a fabric softener or an anti-cling agent to the rinse water. Accordingly, many automatic washing machines include a rinse aid dispenser that introduces the rinse aid at the beginning of the rinse cycle. In the typical arrangement, the rinse aid dispenser mounts on the top of the agitator post, and the rinse aid is poured into a generally cone-shaped interior cup that holds the rinse aid during the wash/agitate cycle. During the spin cycle, centrifugal force causes the liquid rinse aid to spray up and out of the cup, and the centrifugal force retains the rinse aid against the interior wall of a cylindrical housing that surrounds the cup. When the spinning stops, the rinse aid drains down a funnel into a chamber of the agitator post from where it enters the spin basket through one or more slots in the post.

The above described arrangement generally operates effectively under the normal conditions when the spin axis is substantially vertical However, problems may occur if there is an unbalanced or out-of-balance wash load such that the agitator post and the dispenser orbit about the vertical axis. One problem is that rather than being uniformly spread around the interior wall of the housing after leaving the cup, the orbiting cause the rinse aid to congregate in an angular region such as a 90° quadrant. As a result, the normal height of the rinse aid increases on the wall of the housing, and the rinse aid can be forced over the top of the cup and back out the fill hole. Such operation is undesirable because the rinse aid can stain the clothes if it sprays outwardly on them in its concentrated form. The concentrated rinse aid can also stain the clothes as a result of another problem associated with out-of-balance orbiting. More specifically, during spin acceleration at or near critical spin speed (e.g. 250 rpm) before the spin acceleration mass effectively reduces the orbiting distance, the orbiting may be so extreme that the rinse aid is not effectively held against the housing wall by centrifugal force, and some may drain prematurely down through the drain hole in the funnel. Then, by centrifugal force during high speed spin, the concentrated rinse aid can be sprayed out through the slot onto the clothes.

Further, staining of the clothes can also result if some of the rinse aid leaves the cup and passes into the housing prematurely during the wash/agitate cycle. Such operation can generally result from two different conditions. First, the rapid back and forth motion of the agitator post during agitation can cause wave action in the rinse aid in the cup thus causing the rinse aid to splash out over the rim. Second, the rinse aid can be siphoned out of the cup by a negative pressure within the housing caused by the rise and fall of wash water in the agitator chamber within the agitator as created by the back and forth oscillation of the agitator.

Further, staining of the spin dried wash clothes can occur as rinse aid residue drains off the interior walls of the dispenser into the agitator chamber and out the slots into the wash load.

The above described rinse aid dispensers have been made in large and compact sizes. The above-described clothes staining problems are improved (i.e. not so severe) with large dispensers due to a number of reasons. For example, there is more volume in the housing so it is less likely that the rinse aid will spray out of the fill hole. Also, the centrifugal force is greater with a large dispenser, so it is less likely that the centrifugal force will not be large enough to prevent the rinse aid from prematurely draining out the bottom. Further, with a large dispenser, the holding cup can be made larger so the rinse aid can be diluted. Thus, its staining tendency is reduced, and also diluted rinse aid is less likely to accumulate on the interior of the dispenser and drip down at a later time. However, one serious drawback of a large dispenser is that it limits the access opening to the clothes basket for loading and unloading clothes.

SUMMARY OF THE INVENTION

It is an object of the invention to provide an improved rinse aid dispenser for an automatic washing machine.

It is a further object to provide a compact rinse aid dispenser that does not unduly encroach on the access opening for loading and unloading clothes.

It is an object that the rinse aid dispenser prevent rinse aid from spraying out the fill hole or draining down the drain hole notwithstanding an unbalanced load condition that causes orbiting during a spin cycle.

It is a further object to provide a rinse aid dispenser that prevents rinse aid from splashing out of the holding cup during agitate operation.

It is a further object to provide a rinse aid dispenser that prevents rinse aid from being siphoned from the cup during an agitate cycle.

It is a further object to provide a rinse aid dispenser that prevents rinse aid from collecting on the interior surfaces and dripping down and out of the agitator slot at an undesirable time.

In accordance with the invention, a rinse aid dispenser is adapted for mounting on top of an agitator post of an automatic washing machine that sequences through wash, spin, and rinse cycles wherein the dispenser dispenses a liquid rinse aid at the end of the first spin cycle down into a chamber in the agitator post from where the rinse aid flows out through a slot in the agitator post into the spin basket. The dispenser comprises a cup for holding the rinse aid during the agitate cycle wherein the cup has an outwardly sloped or generally cone-shaped wall such that the rinse aid is forced up and over the rim of the wall by centrifugal force during a spin cycle. The cup is surrounded by a housing having a cylindrical wall wherein the wall retains the rinse aid from the cup by a centrifugal force during the spin cycle, and the housing further has a cover comprising a horizontal top with a central fill hole surrounded by a cylindrical barrier that extends downwardly into the cup with its lower edge being proximately spaced from an interior portion of the cup. The dispenser further comprises a bottom having a central drain opening and a rim portion sealed to the cylindrical wall of the housing wherein the rinse aid retained against the cylindrical wall of the housing by centrifugal force during the spin cycle drains down through the drain opening into the agitator post by gravity at the completion of the spin cycle. It is preferable that the barrier wall comprises means for inhibiting rinse aid from splashing out of the cup into the housing as a result of agitator motion during the wash cycle. It is also preferable that the barrier wall has a lower portion with an inside surface that slopes outwardly in the downward direction. Further, it is preferable that the bottom have a funnel shape down to the drain opening. It is also preferable that the bottom comprise means for restricting the flow of the rinse aid through the drain opening during the spin cycle. For example, the restricting means may comprise a dome with a doorway on one side over the drain hole and a wall spacedly surrounding the dome and having a doorway which is not aligned with the dome doorway. Such restricting means may preferably comprise a labyrinth.

With such arrangement, the horizontal top and the cylindrical barrier extending downwardly therefrom into the cup prevent rinse aid from being forced from the housing up through the fill hole when the rinse aid congregates in one quadrant as a result of out-of-balance orbiting. Further, the cylindrical barrier is proximately spaced from an interior portion of the cup to inhibit rinse aid from being splashed into the housing from the cup during an agitate cycle. Also, the slope on the inner surface of the barrier aids in reducing wave motion in the rinse aid during an agitate cycle. Further, the labyrinth arrangement provides a restriction that tends to resist the rinse aid from draining through the drain hole of the bottom during a spin cycle in which there is an unbalanced load causing the agitator post and dispenser to orbit about the vertical axis.

BRIEF DESCRIPTION OF THE DRAWINGS

The foregoing objects and advantages will be more fully understood by reading the description of the preferred embodiments wherein.

DESCRIPTION OF THE PREFERRED EMBODIMENTS

Figure 1:
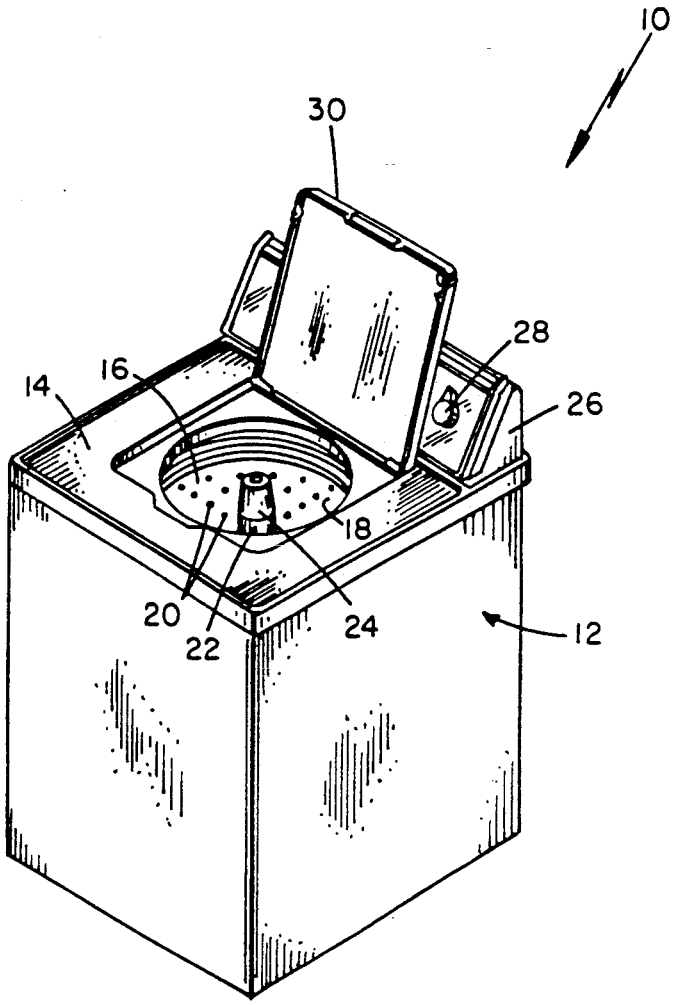
FIG. 1 is a perspective view of an automatic top-loading washing machine.

Referring to FIG. 1, an automatic top-loading washing machine 10 includes a cabinet 12 with a top panel 14 having an access opening 16 down into a spin basket 18 having perforations 20. An agitator 22 is centrally located within the spin basket 18, and has a detachable rinse aid dispenser 24 mounted to the top thereof. A control console 26 is mounted to the rear of top panel 14 and includes one or more control knobs 28. In conventional manner, clothes are loaded into the spin basket 18 through access opening 16 and, after the lid 30 is closed, control knob 28 is used to initiate a sequence of automatic wash cycles or operations. More specifically, the drain tub (not shown) surrounding the spin basket 18 is filled with water, and then conventional drive apparatus (not shown) is used to rotate agitator 22 back and forth in a reciprocating motion through a predetermined stroke arc to agitate the clothes during a wash cycle. Next, during a spin cycle, the wash water is drained from the drain tub and the spin basket 18 and agitator 22 are rotated at high speed to extract water from the clothes by centrifugal force, such water passing radially outwardly through the perforations 20. In a typical washing operation, the drain tub is then filled with rinse water and the agitator 22 is once again actuated to agitate the clothes. The washing machine 10 is then automatically sequenced through one or more other cycles such as, for example, a second spin cycle.

Figure 2:
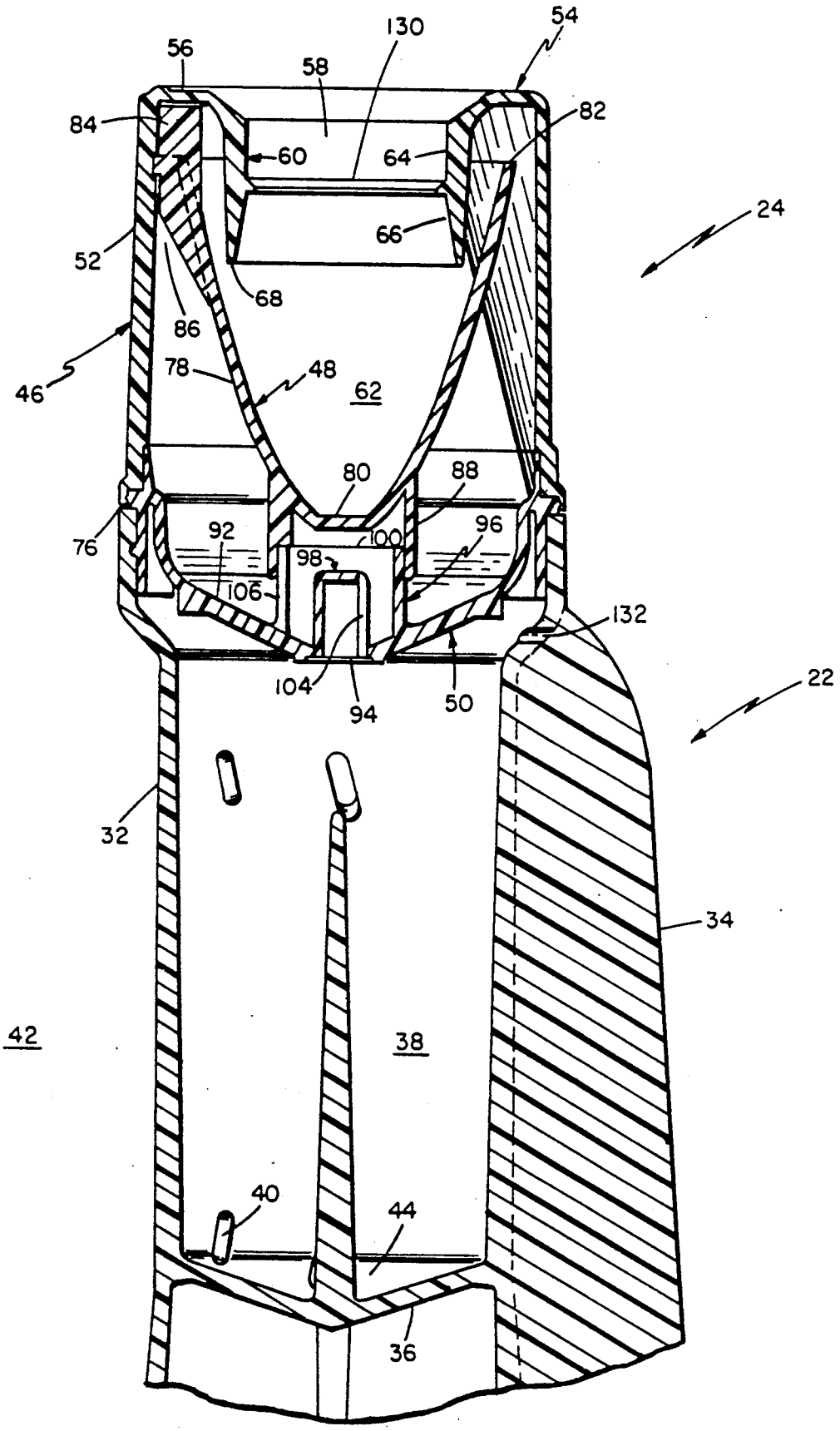
FIG. 2 is a sectioned view of the rinse aid dispenser mounted on the agitator post.

Referring to FIG. 2, a side sectioned view shows the rinse aid dispenser 24 detachably mounted to the top of the post 32 of agitator 22 which also includes one or more vanes 34. The top portion of agitator post 32 is hollow with a floor portion 36 forming a chamber 38 within post 32. Located near floor portion 36 at the bottom of chamber 38 is one or more slots 40 which communicate from chamber 38 to the interior 42 of spin basket 18. Floor portion 36 preferably slopes downwardly towards the center of post 32 thereby defining a pocket 44 or sump region of chamber 38 below the level of slots 40.

Figure 3:
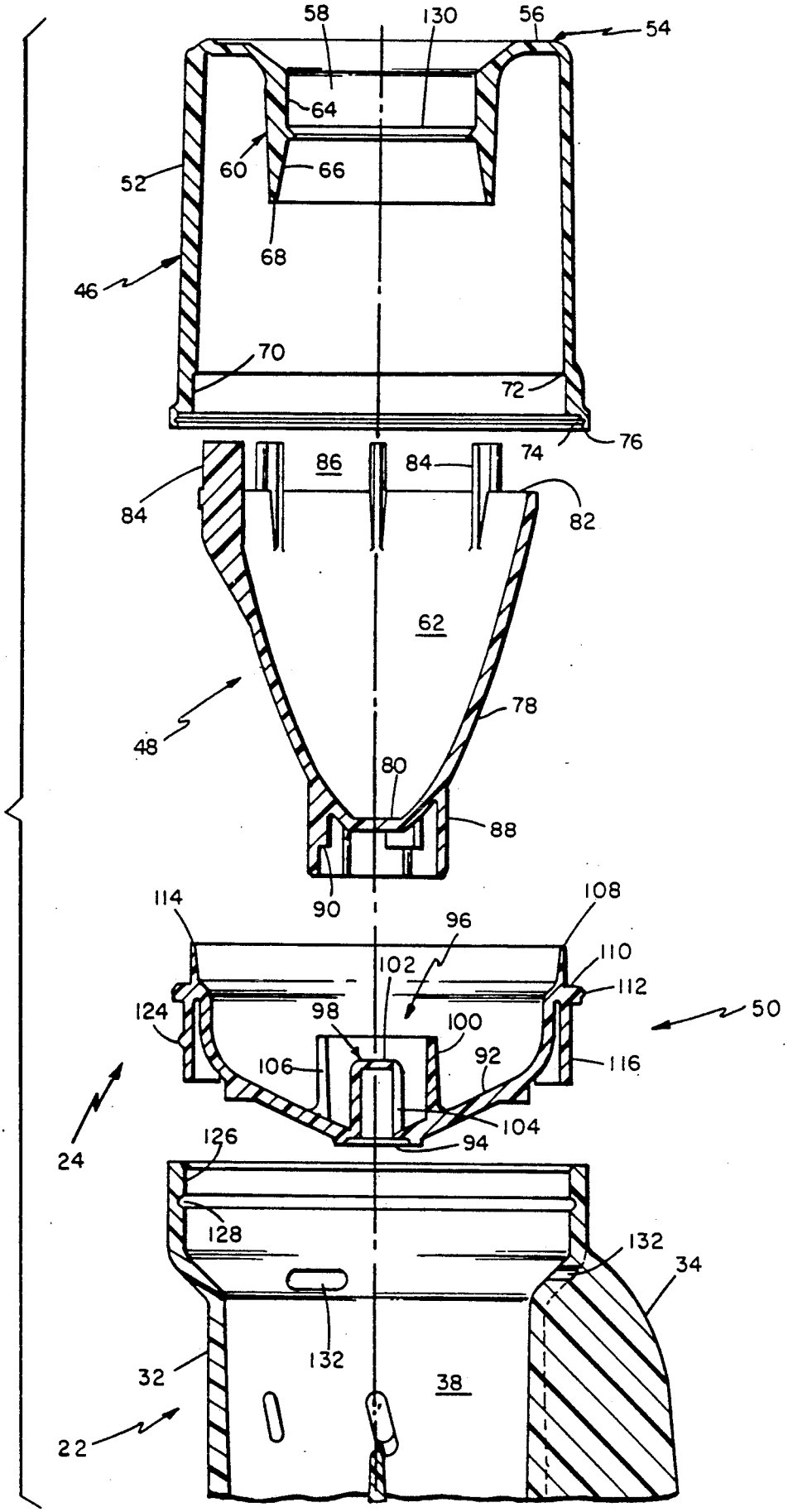
FIG. 3 is an exploded view of the rinse aid dispenser.

Still referring to FIG. 2, rinse aid dispenser 24 includes housing 46, dispenser or holding cup 48, and funnel 50 all of which are plastic molded parts. FIG. 3, shows an exploded view of rinse aid dispenser 24, and illustrates that housing 46, dispenser cup 48, and funnel 50 can be disengaged from agitator post 32 and disassembled from each other for cleaning. Housing 46 has a substantially cylindrical wall 52 and a cover 54 with an inwardly directed horizontal wall 56 or top portion in which a fill hole 58 is provided. Here, fill hole 58 has a diameter of 1½". A substantially cylindrical vertical wall 60 or barrier surrounds fill hole 58 and extends downwardly into the interior of housing 46 concentric with cylindrical wall 52. The inner surface 64 of barrier 60 has a lower portion 66 that is flared or angled outwardly in the downward direction. Stated differently, from the tip 68 of barrier 60, the lower portion 66 is angled inwardly at a slope such as, for example, 9° from vertical for a distance of ½". The bottom of horizontal wall 52 has a pilot region 70 leading up to shoulder 72, and a circumferential groove 74 is provided adjacent the bottom edge 76.

Holding cup 48 is generally cone-shaped wherein wall 78 flares outwardly from the bottom 80 of relatively small diameter to a rim 82 of relatively large diameter, such as, for example, 2½ inches. In other words, wall 78 slopes outwardly in the upward direction. A plurality of spacers 84 extend outwardly and upwardly from various spaced locations around the circumference of rim 82. In the first step of assembling rinse aid dispenser 24, cup 48 is inserted up into housing 46, and spacers 84 function to accurately locate rim 82 with respect to cylindrical wall 52 and horizontal wall 56 while providing a plurality of gaps or passageways 86 from the interior 62 of cup 48 up and over rim 82 between spacers 84 into the lower interior of housing 46 outside cup 48. Cup 48 also has a cylindrical base 88 having interior steps 90.

Figure 4:
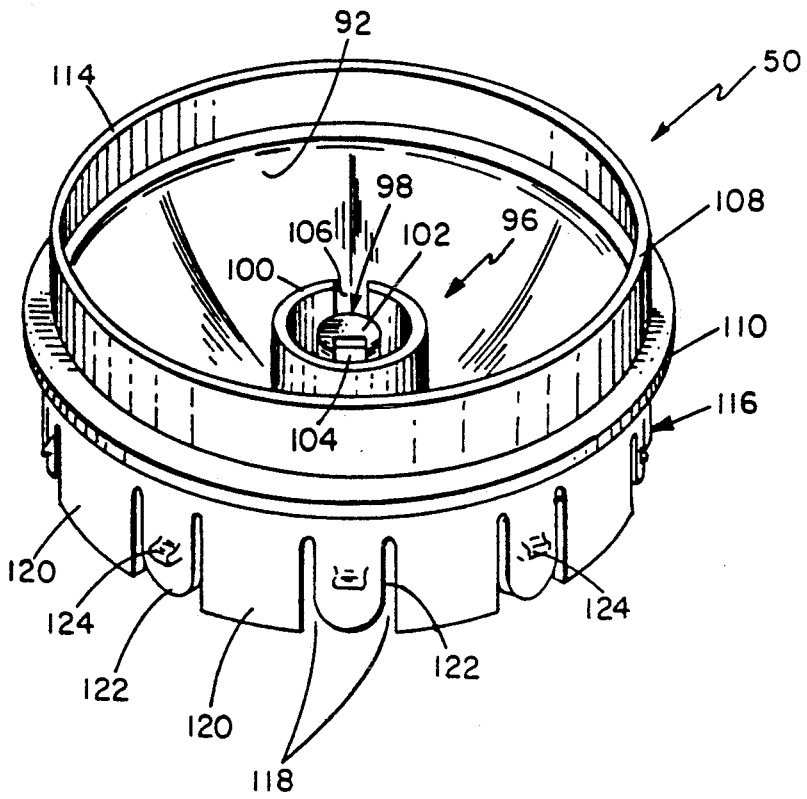
FIG. 4 is a perspective view of the funnel of the rinse aid dispenser.

Funnel 50 has a wall 92 that slopes downwardly to a centrally located drain hole 94. A labyrinth 96 surrounds drain hole 94 on the upper surface of wall 92. More specifically, with reference also to FIG. 4, labyrinth 96 includes a dome 98 covering drain hole 94 and a spaced concentric wall 100. Dome 98 has a lid 102 and a passageway 104 or doorway located on one side. Wall 100 has a void 106 or doorway which is on the opposite side such that doorway 106 is non-aligned with doorway 104. Thus, as will be described later herein, liquid in funnel 50 does not have a direct route to flow to drain hole 94. Funnel 50 also has an extended lip 108 that conforms with pilot region 70 of housing 46. Spaced below lip 108 is a flange 110 with a bead 112 that conforms with groove 74 of housing 46. Thus, after cup 48 is inserted in housing 46, the assembly of rinse aid dispenser 24 is completed by inserting extended lip 108 of funnel 50 into the pilot region 70 of housing 46, and forcing the two members together so that bead 112 snaps into groove 74. There is an interface fit between bead 112 and groove 74 thereby detachably holding the rinse aid dispenser 24 assembly together. The extended lip 108 guides the funnel 50 into the pilot region 70 of housing 46, and, after mating, the tip 114 forms a seal against shoulder 72. The extended lip 108, therefore, aids in forming a seal between funnel 50 and housing 46 thereby preventing the escape of rinse aid. Lip 108 also increases the structural rigidity of the dispenser 24 thereby preventing the housing 46 from easily being dislodged from funnel 50. The structural rigidity of dispenser 24 is also enhanced by base 88 sliding down over wall 100 and steps 90 resting on the top of wall 100.

Extending cylindrically downwardly from flange 110 is a band 116 with a plurality of vertical slits 118 forming a plurality of semi-rigid fingers 120 interposed by narrower flex fingers 122 each of which has an outwardly extending button 124. Band 116 generally conforms with a pilot region 126 on the internal surface of agitator post 32 such that band 116 can be journaled or guided down into pilot region 126. A circumference as defined by the plurality of buttons 124 is larger than the internal circumference of agitator post 32 such that as band 116 is being guided down into pilot region 126, the flex fingers 122 deflect inwardly until they reach groove 128 in the internal surface of agitator post 32. At such position, the flex fingers 122 snap outwardly as the buttons 124 seat in groove 128 thus detachably locking rinse aid dispenser 24 to the top of agitator post 32.

In operation, a liquid rinse aid such as fabric softener or an agent that reduces static cling, is poured into the fill hole 58 as shown in FIG. 2 before the commencement of the sequence of washing cycles. More specifically, the liquid rinse aid is added at the same time that the clothes are being loaded and control knob 28 is being set. The rinse aid is held in cup 48 during the wash/agitate cycle. Cup 48 is relatively small such as, for example, having a top diameter of 2½" and a height of 2½", so as to provide a compact rinse aid dispenser 24 that leaves a relatively large area of access opening 16 for loading and unloading clothes. More specifically, the size of cup 48 is limited because housing 46 may have an upper diameter of 3" and a lower diameter of 3.25". Thus, in order to load a sufficient quantity of liquid rinse aid into dispenser 24, cup 48 must be filled relatively full, and a concentrated (i.e. not diluted) rinse aid must be used. In the normal arrangement, the rinse aid may be filled to the fill line 130 which is relatively near the rim 82 of cup 48. In the intended operation, the rinse aid is held in dispenser cup 48 for the wash/agitate cycle wherein the agitator 22 and the rinse aid dispenser 24 are rotated back and forth through a predetermined arc in a stroke action such as, for example, 60 strokes/minute. As shown in FIG. 2, the tip 68 of barrier wall 60 is proximately spaced to an inner surface region of cup 48. For example, a preferable gap is ⅛" between cup 48 and vertical barrier 60 so as to reduce the wave action in the rinse aid during an agitate cycle, yet allowing a gap sufficient to dispense the rinse aid as will be described. Further, the lower portion 66 of barrier wall 60 is tapered and this tends to force the rinse aid inward towards the center to further counteract the wave action created by the agitate oscillations. Reducing the wave action helps to prevent rinse aid from splashing over rim 82 or splashing back out through fill hole 58 during the wash/agitate cycle when it is desirable to retain all of the rinse aid in cup 48.

Still referring to FIGS. 2 and 3, at least one vent aperture 132 is provided near the top of agitator post 32 above the wash water line in spin basket 18, and provides a communication path to chamber 38 so that a negative pressure is not created in chamber 38 as a result of wash water moving up and down therein during an agitate cycle. Thus, during a wash/agitate cycle, the same pressure is maintained above the rinse aid and the interior of housing 46. Thus, the rinse aid is prevented from being siphoned over rim 82 of cup 48 by a negative pressure during a wash/agitate cycle.

During the spin cycle, centrifugal force causes the rinse aid to move up the cone-shaped wall 78 of cup 48, and it flows through passageways 86 and is retained against cylindrical wall 52 of housing 46 by centrifugal force. One feature of the inclined surface of the lower portion 66 of barrier wall 60 is that during the beginning of the spin cycle, it tends to cause the rinse aid against it to be directed downwardly so that it may pass through the ⅛" gap between the tip 68 and wall 78. In normal operation, the liquid rinse aid collects 360° around the inner surface of cylindrical wall 52, and, with centrifugal force and gravity operating on the rinse aid, it extends approximately half way up housing 46. However, if there is an out-of-balance load condition such that agitator 22 and rinse aid dispenser 24 orbit about the vertical axis, the liquid rinse aid tends to congregate in one region such as, for example, a 90° quadrant. Further, with the tilt of the agitator 22, the rinse aid 134 tends to be positioned at the top of housing 46 as shown in FIG. 2. Cover 54 including horizontal wall 56 and barrier wall 60 prevent the rinse aid 134 from spraying out the fill hole 58 during this condition. In other words, without cover 52 extending radially inward and downwardly as defined by barrier wall 60, the rinse aid 134 could be sprayed out the top and land on the clothes in its concentrated form thereby staining the clothes. Also, the narrowness of the gap between tip 68 and cup 48 constricts the rinse aid 134 thereby reducing the tendency for rinse aid 134 to re-enter cup 48.

During spin acceleration at or near critical spin speed (e.g. 250 rpm) where an out-of-balance load causes the agitator post 32 and rinse aid dispenser 24 to be at their most extreme orbit, some rinse aid 134 may drain towards the bottom of wall 92 of funnel 50. Labyrinth 96 resists such rinse aid from flowing through drain hole 94 before the completion of the spin cycle. More specifically, there is no direct path for the rinse aid because it must first pass through void 106 in wall 100 and then flow around dome 98 to passageway 104. Accordingly, funnel 50 has a slope such as, for example, 25°, but rinse aid 134 is prevented from draining through drain hole 94 notwithstanding the existence of an out-of-balance condition. When the spin speed slows down at the end of the spin cycle and gravity overcomes the centrifugal force, rinse aid 134 that was retained against cylindrical wall 52, and also any small amount retained against wall 100 will flow through passageway or doorway 104 and drain hole 94 down into chamber 38. As soon as sump 44 fills with rinse aid, the rinse aid flows out through slots 40 and into spin basket 18. Thus, when the outer tub fills with water for the rinse cycle, the rinse aid is mixed with the rinse aid in the intended manner.

Sump or pocket 44 is provided at the bottom of chamber 38 so that if there is any rinse aid residue draining off the interior walls of dispenser 24 after the final spin cycle, the small amount of rinse aid (e.g. up to 4 grams) is accumulated in sump 44 and is not free to flow outwardly through slots 40 where it could stain the clothes. Rather, the residue rinse aid remains in sump 44 until the next wash cycle when it is diluted with wash water.

This concludes the description of the preferred embodiments. A reading of it by one skill in the art will bring to mind many modifications and alterations that do not depart from the spirit and scope of the invention. Accordingly, it is intended that the invention be limited only by the appended claims.

What is claimed is:

1. A rinse aid dispenser adapted for mounting on top of an agitator post of an automatic washing machine that sequences through wash, spin, and rinse cycles, and dispensing a liquid rinse aid at the end of a spin cycle down into a chamber in the agitator post from where the rinse aid flows out through a slot in the agitator post into a spin basket, said dispenser comprising:

a cup for holding said rinse aid during said wash cycle, said cup having an outwardly sloped wall wherein said rinse aid is forced up and over said sloped wall by centrifugal force during said spin cycle;

a housing having a substantially cylindrical wall surrounding said cup wherein said rinse aid from said cup is retained against said cylindrical wall by centrifugal force during said spin cycle, said housing further having a cover comprising a horizontal top with a central fill hole surrounded by a cylindrical barrier that extends downwardly into said cup and has a lower edge that is proximately spaced from an interior portion of said cup; and a bottom having a central drain opening and a peripheral portion sealed to said substantially cylindrical wall of said housing wherein said rinse aid retained against said cylindrical wall of said housing by centrifugal force during said spin cycle drains down through said drain opening into said agitator post by gravity at the completion of said spin cycle.

2. The dispenser recited in claim 1 wherein said barrier comprises means for inhibiting rinse aid from splashing out of said cup into said housing as a result of agitator motion during said wash cycle.

3. The dispenser recited in claim 1 wherein said barrier has a lower portion with an inside surface that slopes outwardly in the downward direction.

4. The dispenser recited in claim 1 wherein said bottom is funnel-shaped down to said drain opening.

5. The dispenser recited in claim 1 wherein said bottom comprises means for restricting the flow of said rinse aid through said drain opening during said spin cycle.

6. The dispenser recited in claim 5 wherein said restricting means comprises a dome with a doorway on one side positioned over said drain hole, said restricting means further comprising a wall spacedly surrounding said dome and having a doorway non-aligned with said dome doorway.

7. The dispenser recited in claim 5 wherein said restricting means comprises a labyrinth.

8. In a washing machine that automatically sequences through wash, spin, and rinse cycles, apparatus comprising:

a spin tub;

an agitator positioned in said spin tub, said agitator comprising a post having a hollow upper chamber and at least one slot near the bottom of said chamber communicating from said chamber to the interior of said spin tub;

means for driving said agitator back and forth in a reciprocating motion through a predetermined arc during said wash cycle and for spinning said agitator and said spin tub unidirectionally during said spin cycle;

a rinse aid dispenser mounted to the top of said agitator post, said dispenser comprising a housing having a substantially cylindrical wall and a cover having a central fill hole, said cover having a downwardly extending barrier wall surrounding said fill hole;

said dispenser further comprising means comprising a cup positioned in said housing for holding rinse aid during said wash cycle, said cup comprising a substantially cone-shaped wall with means for spacing the upper rim of said cup from said cylindrical wall and said cover of said housing thereby providing a passageway from said cup over said rim and down into said housing, said downwardly extending barrier wall of said cover extending down into said cup and being spaced therefrom wherein, during said wash cycle, said barrier wall resists said rinse aid from splashing over said rim of said cup into said housing and, during said spin cycle, said rinse aid climbs up said cone-shaped wall and over said rim through said passageway by centrifugal force and is forced radially outwardly against said cylindrical wall of said housing by said centrifugal force; and said dispenser further comprising a funnel-shaped bottom having a central drain hole and a peripheral portion sealed to said cylindrical wall of said housing wherein, when said spinning cycle is completed, said rinse aid drains from said cylindrical wall of said housing down said funnel-shaped bottom and into said agitator chamber through said drain hole from where said rinse aid enters said spin basket through said at least one slot in said post.

9. The washing machine recited in claim 8 wherein said funnel-shaped bottom further comprises a labyrinth surrounding said drain hole to resist the flow of said rinse aid through said drain hole during said wash cycle.

10. The washing machine recited in claim 8 wherein said chamber in said agitator post has a pocket below said at least one slot.

11. The washing machine recited in claim 8 wherein said agitator post comprises an air passageway from said chamber into the interior of said spin basket above the level of wash water during said wash cycle.

12. The washing machine recited in claim 8 wherein said barrier wall has a lower portion with an inside surface that slopes outwardly in the downward direction.

13. The washing machine recited in claim 8 wherein said funnel-shaped bottom comprises a dome covering said drain hole and a wall concentrically spaced outwardly therefrom, said dome and said concentric wall having non-aligned doorways to provide a labyrinth passageway for said draining rinse aid.

14. A rinse aid dispenser adapted for mounting on top of an agitator post of an automatic washing machine that sequences through wash, spin, and rinse cycles, and dispensing a liquid rinse aid at the end of a spin cycle down into a chamber in the agitator post from where the rinse aid flows out through a slot in the agitator post into a spin basket, said dispenser comprising:

a housing having a substantially cylindrical wall and a fill hole on top;

a cup positioned in said housing for holding rinse aid during said wash cycle, said cup comprising a substantially cone-shaped wall spaced from said housing wherein, during said wash cycle, said cup holds said rinse aid and, during said spin cycle, said rinse aid climbs up said cone-shaped wall and is retained against said cylindrical wall of said housing by centrifugal force; and a funnel-shaped bottom having a drain hole for dispensing said rinse aid into said agitator post at the end of said spin cycle, said funnel-shaped bottom comprising a labyrinth for restricting the passage of said rinse aid to said drain hole.

15. The dispenser recited in claim 14 wherein said labyrinth comprises a dome covering said drain hole and a wall concentrically spaced outwardly from said dome, said dome and said wall having doorways o opposite sides.

16. The dispenser recited in claim 14 wherein said housing comprises a cover in which said fill hole is disposed, said cover having a cylindrical barrier wall surrounding said fill hole and extending down approximately ⅛" from said cup.

17. The dispenser recited in claim 16 wherein said barrier wall has an inner surface portion with an outward slope in the downward direction.

* * * * *